US005895040A

United States Patent [19]

Oleksa et al.

[11] Patent Number: 5,895,040

[45] Date of Patent: Apr. 20, 1999

[54] SHEET SEPARATOR

[75] Inventors: Stephen Alexander Oleksa; Jerry Wesley Raider, both of Lexington, Ky.

[73] Assignee: Lexmark International, Inc., Lexington, Ky.

[21] Appl. No.: 08/879,351

[22] Filed: Jun. 20, 1997

[51] Int. Cl.[6] ..... B65H 3/52

[52] U.S. Cl. ..... 271/124; 271/167

[58] Field of Search ..... 271/121, 167, 271/124, 104, 137, 138

[56] References Cited

U.S. PATENT DOCUMENTS

| | | | |
|---|---|---|---|
| 3,871,641 | 3/1975 | Marx et al. | 271/167 X |
| 4,579,332 | 4/1986 | Larson | 271/121 X |
| 4,822,023 | 4/1989 | Miyoshi | 271/167 X |
| 4,887,806 | 12/1989 | Tanaka et al. | 271/121 |
| 5,052,677 | 10/1991 | Shibata | 271/164 |
| 5,277,417 | 1/1994 | Moritake et al. | 271/121 |
| 5,527,026 | 6/1996 | Padget et al. | 271/121 X |

FOREIGN PATENT DOCUMENTS 0792827 9/1997 European Pat. Off. .

*Primary Examiner*—David H. Bollinger
*Attorney, Agent, or Firm*—John A. Brady

[57] ABSTRACT

A dam has a plurality of substantially parallel ribs extending from a base surface. At least one of the ribs is formed of a body of metal having a coating as its exterior surface, which has a low coefficient of friction over which sheets of a media move. The body has a longitudinal slot in its exterior surface. An insert, which has a high coefficient of friction with sheets of a media and is preferably polyurethane, is supported within the body. The insert is preloaded so that a projection extends a predetermined distance through the slot in the body for engagement with each advancing sheet. When the sheet is stiff, the projection is pushed interior of the body so that the low coefficient of friction surface, which has a much larger area for engaging the sheet than the insert, of the body is engaged by the advancing sheet. When the sheet is flexible, the projection of the insert engages the advancing edge of the sheet so that only the high coefficient of friction of the insert is initially engaging the advancing sheet to cause it to buckle or become corrugated so that portions of the sheet engage the low coefficient of friction of the exterior surface of the body to separate the sheet from the next adjacent sheet in the stack.

18 Claims, 12 Drawing Sheets

SHEET SEPARATOR

FIELD OF THE INVENTION

This invention relates to a sheet separator for separating adjacent sheets of media being fed from a stack of sheets so that only one sheet is fed to a process station and, more particularly, to a dam separator separating the uppermost or top sheet of a stack of sheets from the next adjacent sheet during feeding of the top sheet from the stack of sheets of media.

BACKGROUND OF THE INVENTION

One problem in feeding a top sheet of media from a stack of sheets of media is that at least the next adjacent sheet may be fed at the same time. Accordingly, various separating means have previously been suggested for separating a top sheet of a stack of sheets of media from the next adjacent sheet when the feed is from the top of the stack of sheets of media.

It is known to separate a top sheet of a stack of sheets from the next adjacent sheet through using a dam, which is an element having an inclined surface in the path of the top sheet as it is fed from the stack of sheets so that its leading edge will strike the inclined surface of the element. In a printer, for example, the advancement of more than one sheet from the stack of sheets can cause jamming. Therefore, it is necessary to avoid simultaneous advancement of more than one sheet from a stack of sheets of media to a processing station such as a printer, for example.

One previously suggested dam has its inclined surface formed with longitudinally extending ribs so that there is corrugation of a sheet of media between the substantially parallel ribs when the sheet is advanced longitudinally along the exterior surface of each of the ribs. This corrugation is due to a buckling force created by resistance to movement of the sheet by the exterior surface of each of the ribs. While this dam is usually successful in separating an uppermost or top sheet from the next adjacent sheet in a stack of sheets, it is not always successful. Thus, multiple feeding of sheets can occur as the sheets advance up the inclined, ribbed surface of the dam.

Additionally, a surface having a coefficient of friction low enough to separate a relatively heavy media such as cardstock, envelopes, and labels, for example, without causing the feed motor to have too heavy a load will result in more multiple sheet feeding of a relatively light weight media with high friction between sheets such as bond or xerographic paper, for example. This presents the problem of whether to have an inclined surface of a dam capable of reliably separating heavy media or light media. This is not desirable with a printer since a printer needs to be capable of printing both heavy and light media to have a sufficient market.

SUMMARY OF THE INVENTION

The sheet separator of the present invention overcomes the foregoing problems through successfully separating both heavy, high friction media and light, high friction media with a dam having an inclined surface from which extends a plurality of substantially parallel ribs. The sheet separator of the present invention accomplishes this through having at least one of its substantially parallel ribs provide two surfaces of different coefficients of friction with the media for engaging each fed sheet of media with one of the surfaces having a low coefficient of friction with the media and the other of the surfaces having a high coefficient of friction with the media.

While at least the two outermost ribs extending from the dam have only a low coefficient of friction exterior surface, at least one other of the ribs has a high coefficient of friction surface and a low coefficient of friction surface of a larger area. The high coefficient of friction surface is movable relative to the low coefficient of friction surface so as to become ineffective when a stiff sheet of media is advanced along the substantially parallel ribs.

In the preferred embodiment, the high coefficient of friction material not only has a much smaller area than the low coefficient of friction material but also is surrounded by the low coefficient of friction material. The high coefficient of friction material is preloaded so as to protrude beyond the low coefficient of friction surface prior to engagement by a fed sheet.

Through having the high coefficient of friction surface movable relative to the low coefficient of friction surface and by preloading the high coefficient of friction material, engagement of a sheet of stiff media with the high coefficient of friction material causes the high coefficient of friction material to become flush with the low coefficient of friction material. Thus, a sheet of stiff media is effectively in engagement only with the surface of the low coefficient of friction material.

When feeding a sheet of a media of low stiffness which is flexible, the high coefficient of friction material, which is preloaded to protrude beyond the low coefficient of friction material, remains in position and increases the resistance force to the advancing sheet. As a result, the advancing sheet buckles or corrugates. When corrugation or buckling occurs, a large portion of the load from the sheet is taken by the low coefficient of friction surface with an upward, vertical force component. Accordingly, the sheet moves up the substantially parallel ribs extending from the base surface of the inclined dam.

After the corrugation or buckle ceases to exist because of the upward force component moving the sheet up the substantially parallel ribs extending from the base surface of the inclined dam, feeding of the sheet proceeds upwardly along the substantially parallel ribs.

The increased force of the high coefficient of friction material applied to the top sheet also is applied to other sheets in the stack, particularly the next adjacent sheet in the stack. This increased resistance on the next adjacent sheet holds it in place while the uppermost sheet corrugates or buckles. Accordingly, this prevents double or multiple feeds.

As a sheet is advanced, it first strikes the high coefficient of friction surface and is held back by it. The holding back of the advancing sheet is accomplished by the dam providing a retarding force to all fed sheets.

Sheets in a stack inherently have a sticking force causing them to stick together so as to not separate. Thus, to separate the top sheet from the stack, this sticking force must be overcome by the retarding force.

Because the sheets are bent upward by the dam, retarding force is inversely proportional to the square of the distance from where the feed means such as feed rollers, for example, apply the advancing force to the top sheet of the stack as long as the feed means holds the top sheet against the stack of sheets. The retarding force is proportional to the product of the slope of the dam and the stiffness of the sheet.

Accordingly, the distance is the primary factor controlling the magnitude of the retarding force. Thus, it is desired that the feed means be as close as possible to the dam to have a maximum retarding force so as to prevent double feeding of flexible sheets.

However, it also is required for the feed means to be spaced a minimum distance from the dam because of various factors including the torque of the feed motor increases as the distance decreases to increase the cost of the feed motor, the stiff sheets could be damaged if the retarding force is too large, and preventing pinching of the sheets against the dam. Therefore, the location of the feed means is a compromise between the cost of the feed motor and the possible damage to the stiff sheets and the potential for double feeding of flexible sheets.

An object of this invention is to provide a sheet separator having two surfaces of different coefficients of friction with respect to the media available for separating each sheet of media from the next adjacent sheet in a stack of sheets when a flexible sheet of media is advanced but has only a low coefficient of friction surface effective when a stiff sheet of media is advanced.

Another object of this invention is to provide a sheet separator capable of separating sheets fed from a stack of sheets irrespective of whether the thickness of the sheets in two stacks are different even though the sheets in a specific stack have substantially the same thickness.

A further object of this invention is to provide a sheet separator capable of separating sheets fed from a stack of sheets irrespective of whether the thickness of the sheets in two stacks are different even though the sheets in a specific stack have substantially the same thickness.

Still another object of this invention is to provide a sheet separator having a high retarding force for flexible thin sheets of media without decreasing the distance from the feed means to the dam.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
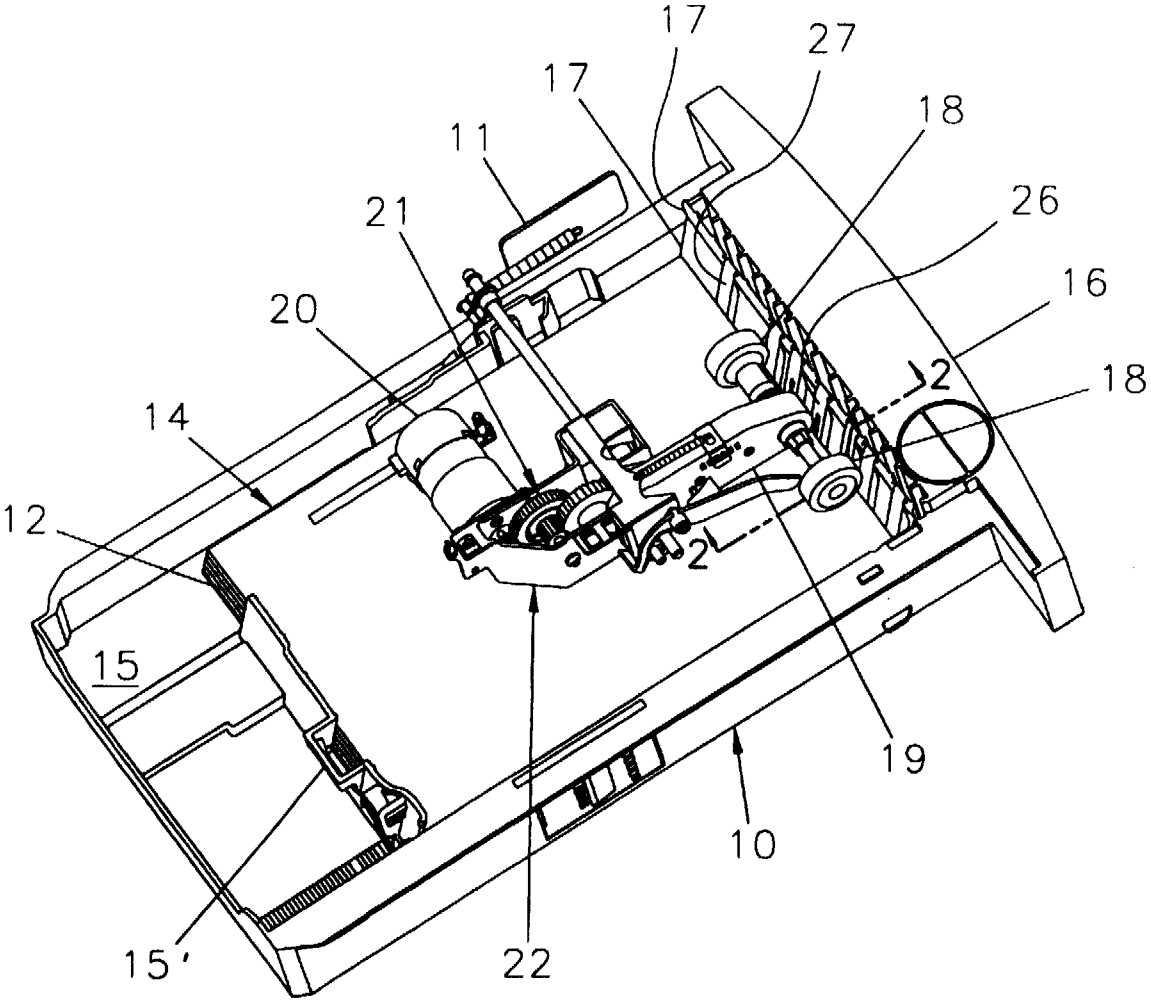
FIG. 1 is a perspective view of a printer tray having a sheet separator of the present invention with a stack of sheets of media therein and the sheets shown thickened for clarity purposes.

Referring to the drawings and particularly FIG. 1, there is shown a tray 10 used in a printer 11. The tray 10 supports a plurality of sheets 12 of a media such as bond paper, for example, in a stack 14. The sheets 12 may be any other suitable media such as labels or envelopes or cardstock, for example.

The tray 10 has a bottom surface or wall 15 supporting the stack 14 of the sheets 12 therein. The tray 10 has a rear restraint 15' abutting a trailing edge of each of the sheets 12 of the stack 14. Adjacent its front end 16, the tray 10 has an inclined surface or wall 17 integral with the bottom surface 15 of the tray 10.

The surface 17 is inclined at an obtuse angle to the bottom surface 15 of the tray 10 and to the adjacent end of the stack 14 of the sheets 12. The inclined or angled surface 17 constitutes a portion of a dam against which each of the sheets 12 in the stack 14 is advanced into engagement. The dam also includes a vertical surface 17' above the inclined surface 17. The sheet 12 is advanced from the vertical surface 17' towards a processing station of the printer 11 at which printing occurs.

Each of the sheets 12 is advanced from the stack 14 of the sheets 12 by a pair of feed rollers 18 of an auto-compensating mechanism, versions of which are particularly shown and described in U.S. Pat. No. 5,527,026 to Padgett et al. The feed rollers 18 are rotatably mounted on a pivotally mounted arm 19.

The feed rollers 18 are driven from a motor 20 through a gear drive train 21. The motor 20, which is supported on a bracket 22, is alternately turned off and on by control means (not shown) as each of the sheets 12 is advanced from the top of the stack 14 of the sheets 12.

Figure 8:
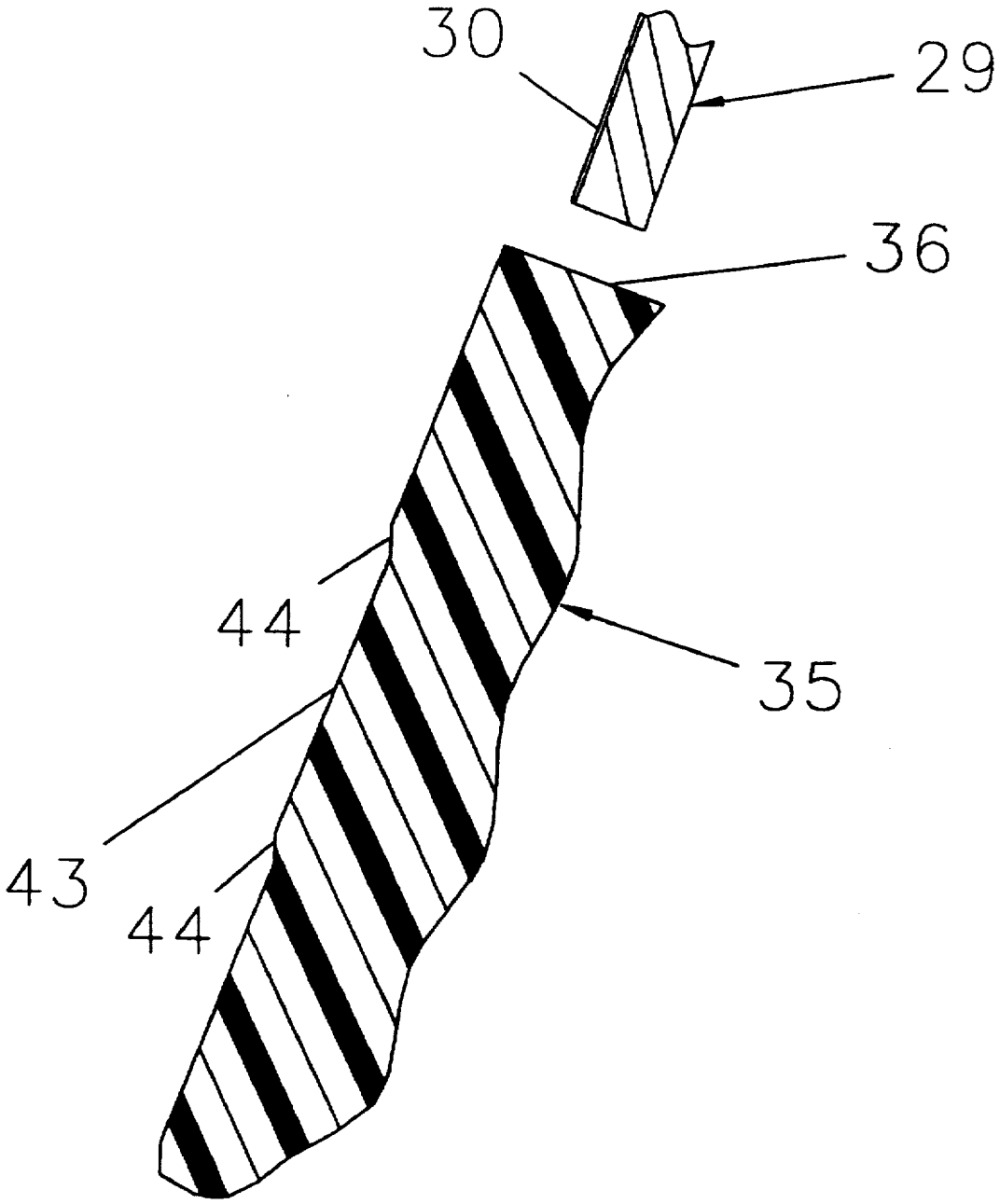
FIG. 8 is an enlarged plan view of another embodiment of a high coefficient of friction surface of an insert of a rib and a portion of a low coefficient of friction surface of a rib in section.
Figure 9:
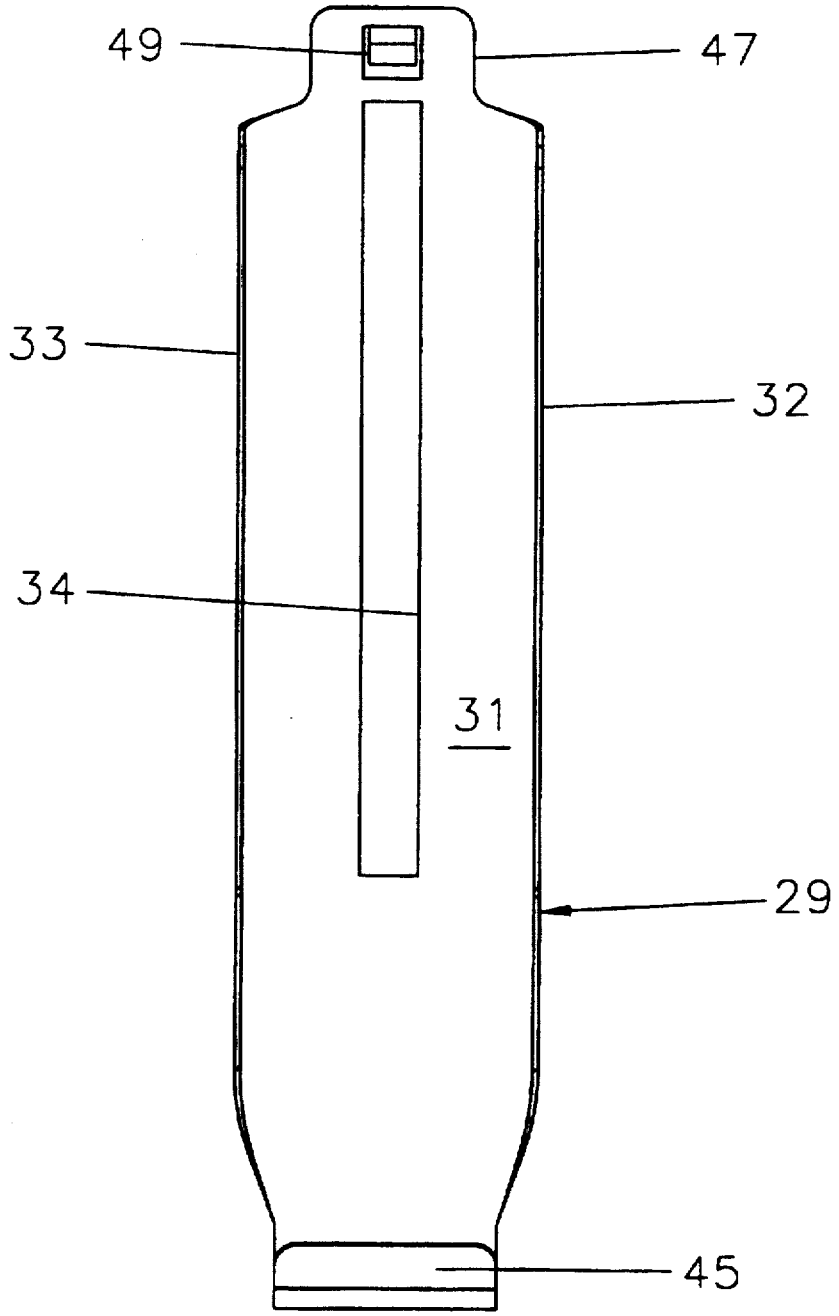
FIG. 9 is a plan view of a body of a rib in which the insert of FIG. 7 is supported.

The inclined surface 17 of the tray 10, which is preferably formed of plastic, has substantially parallel ribs 26 and 27 extending therefrom. Each of the ribs 26 includes a body 29 (see FIG. 4) of metal such as stainless steel, for example, having a coating 30 (Shown enlarged in FIGS. 4, 5 and 8 for clarity purposes.) of a low coefficient of friction material such as TEFLON fluoropolymer, for example, forming its exterior surface. The body 29 includes a main wall 31 (see FIG. 9) having a pair of side walls 32 and 33 extending substantially perpendicular thereto.

The main wall 31 of the body 29 has a longitudinal slot 34 therein. An insert 35 (see FIG. 4) is disposed within the body 29.

Figure 7:
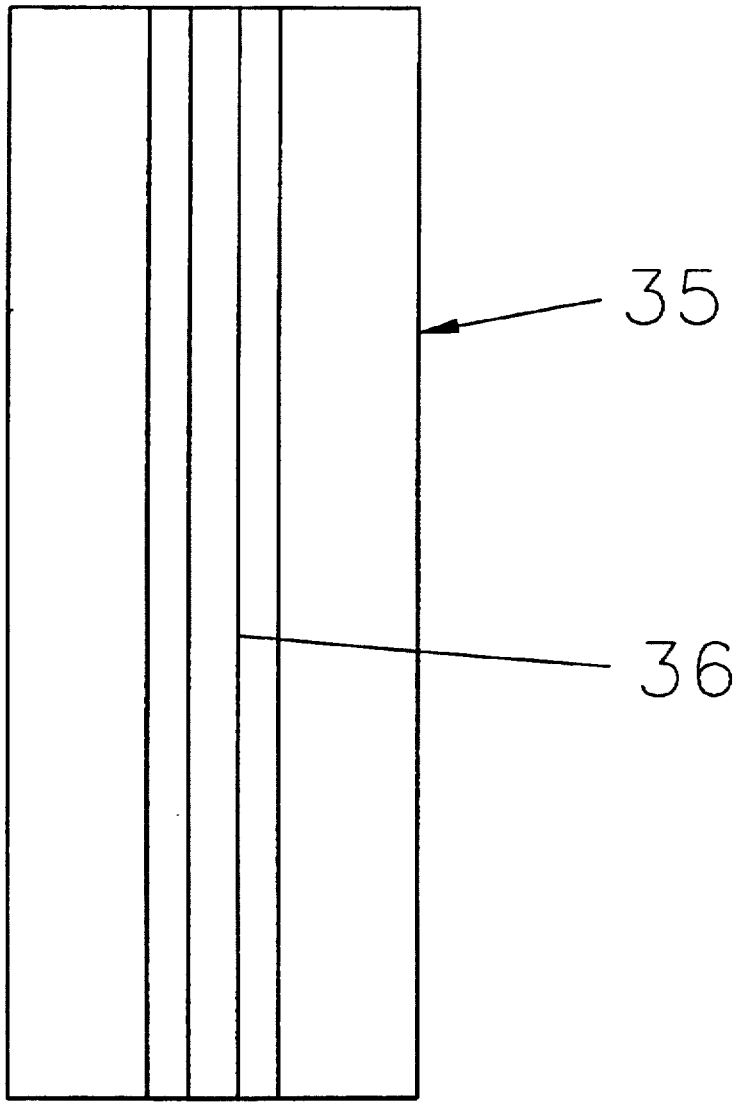
FIG. 7 is an enlarged plan view of an insert of a rib having a high coefficient of friction surface.

The insert 35 is formed of a suitable material having a high coefficient of friction with paper such as polyurethane, for example. One suitable example of the polyurethane is sold by Dow Chemical as Pellethane 2103 70 Shore A. As shown in FIG. 7, the insert 35 has a projection 36 extending along its entire length.

The insert 35 has its substantially parallel side walls 37 (see FIG. 4) engaging the inner surfaces of the side walls 32 (see FIG. 9) and 33 of the body 29. An adhesive, for example, secures the side walls 37 (see FIG. 4) of the insert 35 to the side walls 32 (see FIG. 9) and 33 of the body 29. It should be understood that the insert 35 (see FIG. 4) may be retained by being trapped if desired.

The projection 36 extends beyond the coating 30 on the body 29 for a predetermined distance. For example, when the projection 36 has a width of 1.5 mm, the projection 36 extends 0.15 mm beyond the coating 30 on the body 29. The same proportions would exist for a greater or lesser distance that the projection 36 of the insert 35 extends beyond the coating 30 on the body 29. The distance between the outer surfaces of the side walls 37 (FIG. 4) of the insert 35 is 12.4 mm.

In addition to the configuration of the insert 35 controlling the distance that the projection 36 extends beyond the coating 30 of the body 29, a foam rubber body 38 is disposed between the insert 35 and the inclined surface 17 to exert a further preload on the projection 36. The foam rubber body 38 adds to the preload created by the configuration and material of the insert 35. Thus, the resilience of polymeric insert 35 and the preload combine to determine when the projection 36 is moved by the sheet 12 being a stiff media to the position of FIG. 5.

The projection 36 is proximate or adjacent the coating 30 because there is only a very slight space therebetween. When the sheet 12 is stiff and has a thickness of 0.1 mm and the projection 36 has a width of 1.5 mm and the slot 34 in the body 29 has a width of 2.5 mm, the total preload on the insert 35 should be such that the sheet 12 pushes the sheet engaging surface of the projection 36 flush with the coating 30 as shown in FIG. 5.

The coefficient of friction of the insert 35 with respect to the edge of a sheet of paper is preferably greater than 0.7 and must be greater than 0.3. The coating 30 preferably provides a coefficient of friction with respect to a sheet of paper of less than 0.15 and must be less than 0.2.

Figure 5:
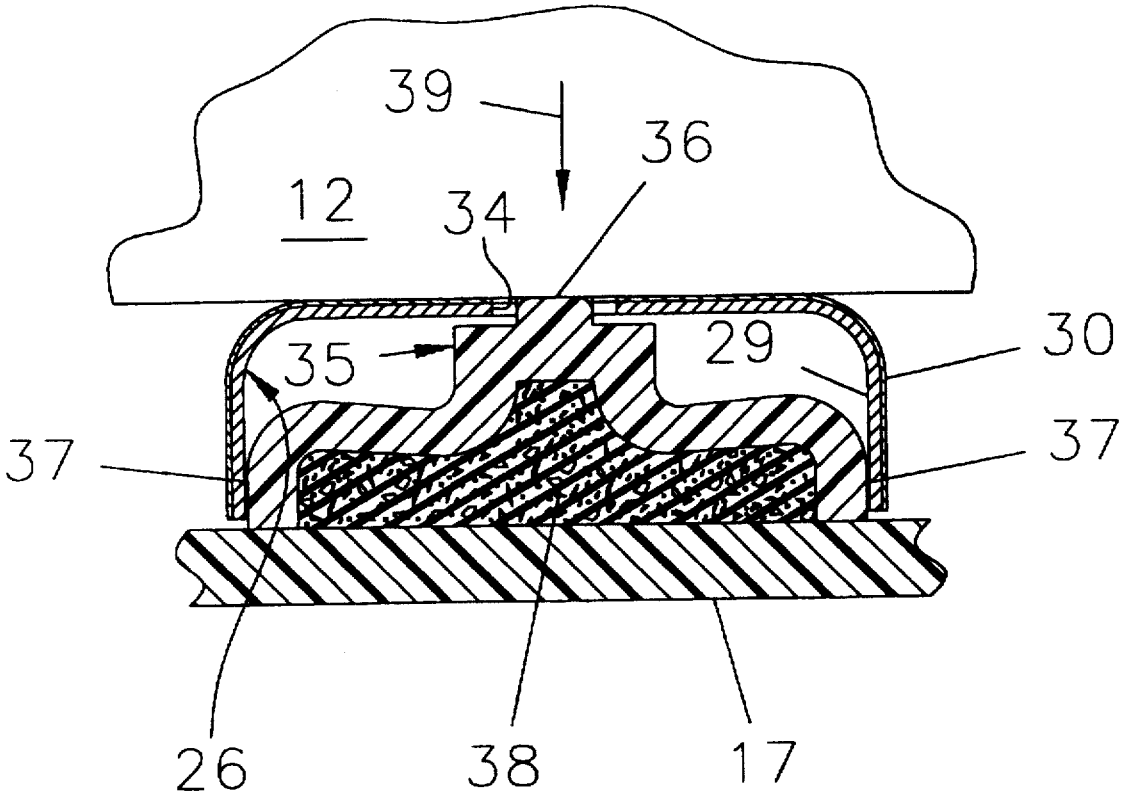
FIG. 5 is a sectional view of a rib having its low coefficient of friction surface engaged by a stiff or relatively heavy weight sheet of media.

When the sheet 12 is stiff, the projection 36 of the insert 35 is moved into the body 29 to the position of FIG. 5 by advancement of the sheet 12 in the direction of an arrow 39. In this way, the total area of the projection 36 engaging the edge of the sheet 12 is very small in comparison with the total area of the coating 30 engaging the edge of the sheet 12. Thus, there is effectively no resistance change in the advancement of the sheet 12 when it is a stiff media than when there is only the coating 30.

Figure 4:
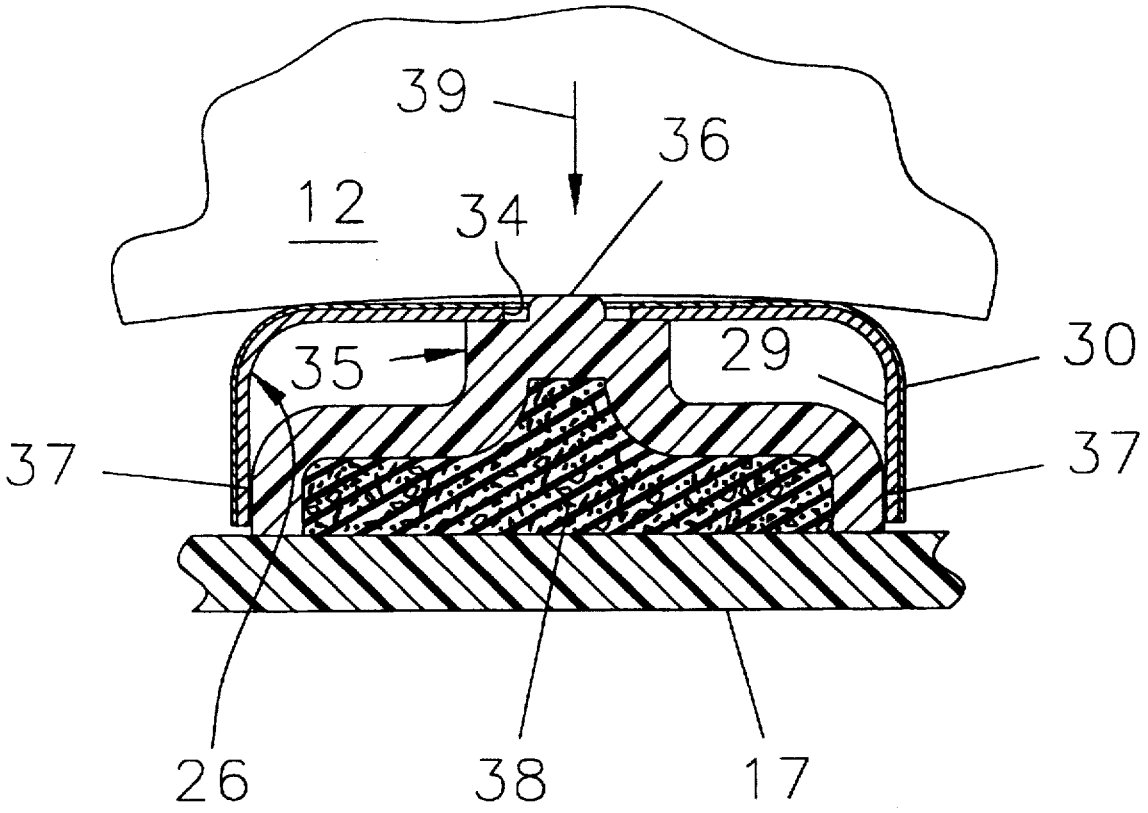
FIG. 4 is a sectional view of a rib having its high coefficient of friction surface engaged by a flexible or relatively light weight sheet of media.

However, when the sheet 12 has a low stiffness so as to be flexible, the projection 36 (see FIG. 4) remains in the position of FIG. 4 as the sheet 12 is advanced in the direction of an arrow 39. Thus, as shown in FIG. 4, the high coefficient of friction projection 36 has a larger area engaging the edge of the sheet 12 in comparison with the coating 30.

As a result, the resistance force to movement of the sheet 12 by the feed rollers 18 (see FIG. 1) increases. Thus, the sheet 12 corrugates or buckles upwardly and inwardly toward the rib 26 as shown in FIG. 10.

Figure 2:
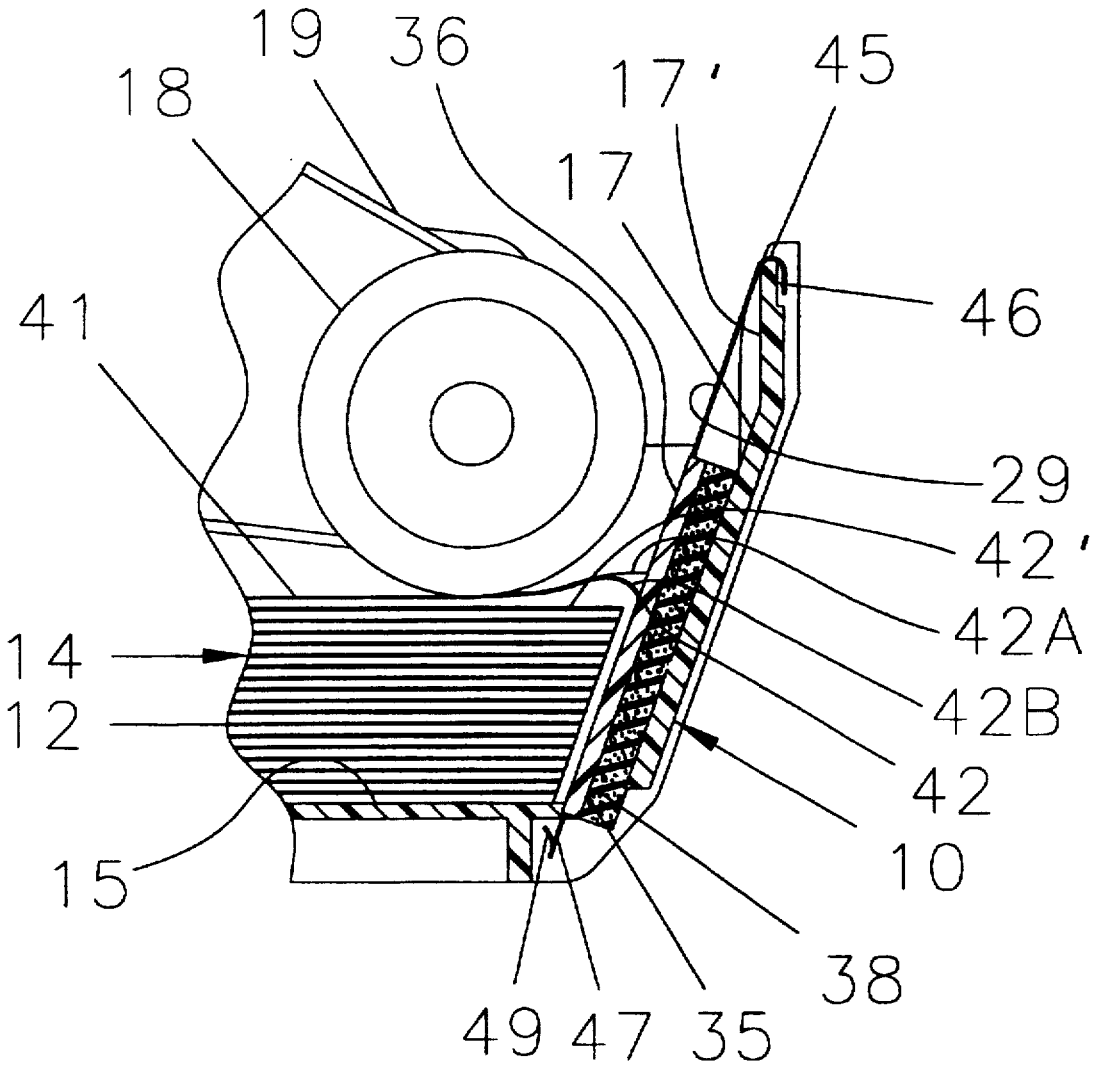
FIG. 2 is a fragmentary sectional view of a portion of the tray of FIG. 1 taken along line 2—2 of FIG. 1 and showing an uppermost sheet of the stack of sheets of light media advanced to engage with a high coefficient of friction surface of a rib.

When the feed rollers 18 (see FIG. 1) are in the feed or sheet advance position of FIG. 2 in which they engage a flexible top sheet 41 of the stack 14 of the sheets 12, the top sheet 41 of the stack 14 is advanced by rotation of the feed rollers 18 through energization of the motor 20. This causes a leading edge 42 of the top sheet 41 to engage the coating 30 (see FIG. 4) on the body 29.

Figure 10:
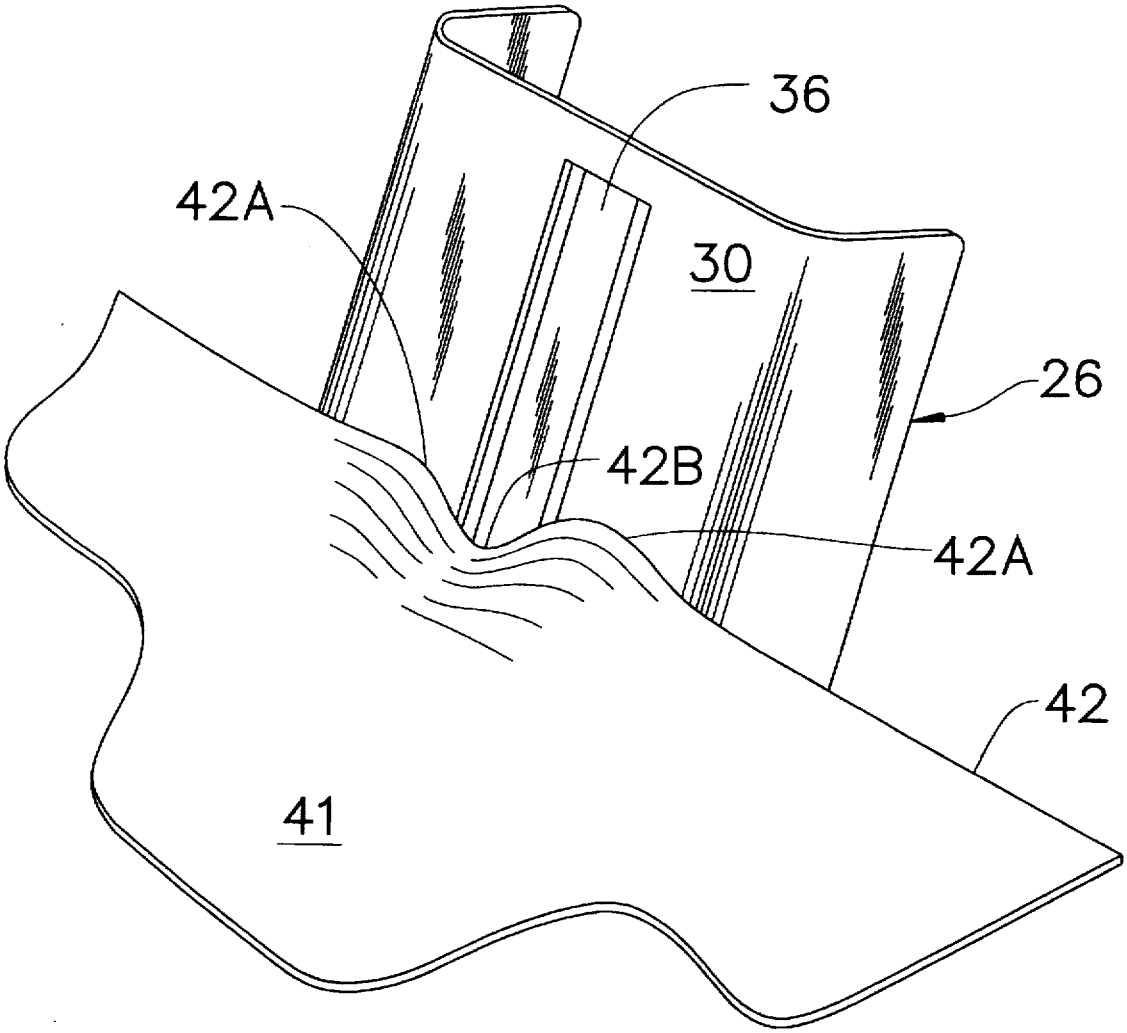
FIG. 10 is a perspective view of a sheet of media having corrugations or buckles formed by engagement with a high coefficient of friction surface of a projection of the insert.

As shown in FIG. 10, corrugation or buckling may occur at one or more of the ribs 26 (see FIG. 1) in the path of the top sheet 41 (see FIG. 2). Once corrugation or buckling occurs (As shown in FIG. 10, there are two upper buckles 42A and one lower buckle 42B), a large portion of the load is taken on the coating 30 (see FIG. 4) with an upward vertical force component; this net upward vertical force component moves the top sheet 41 up the ribs 26 (see FIG. 1) and the ribs 27.

The ribs 27 have only the body 29 (see FIG. 4) with the coating 30. The body 29 of each of the ribs 27 (see FIG. 1) does not have the longitudinal slot 34 (see FIG. 9).

Figure 3:
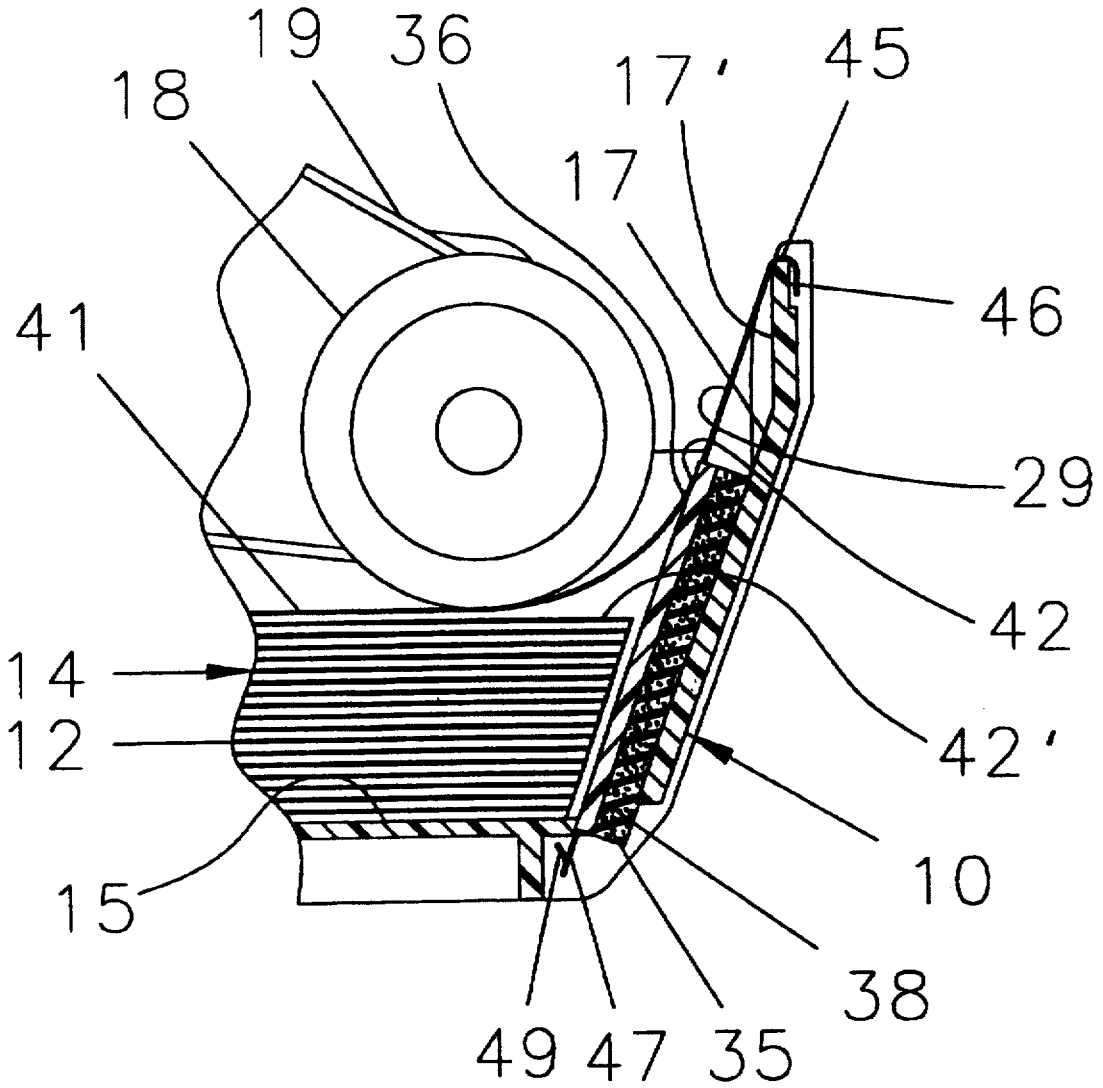
FIG. 3 is a fragmentary sectional view, similar to FIG. 2, showing the uppermost sheet advanced beyond where the buckle collapses.

When the buckles 42A (see FIG. 10) and 42B pop free, the top sheet 41 (see FIG. 3) takes the geometry shown in FIG. 3. The feeding of the top sheet 41 then proceeds up the ribs 26 (see FIG. 1) and 27.

The increased resistance force applied to the top sheet 41 (see FIG. 2) of the stack 14 of the sheets 12 also is applied to other of the sheets 12 in the stack 14, particularly a sheet 42' (see FIG.2) next to the top sheet 41. This increase in resistance on the sheet 42' beneath the top sheet 41 holds the sheet 42' in place while the top sheet 41 is corrugated or buckled, as shown in FIG. 10, so that the top sheet 41 advances. This prevents double feeding.

This increase in resistance is proportional to the coefficient of friction on the high friction surface. Thus, it is desirable to have a very high coefficient of friction surface to maximize the resistance force and minimize double feeds.

It may be difficult to find a material having a reproducible high coefficient of friction in addition to being durable and long lasting. The need for such a material may be obviated by forming the projection 36 (see FIG. 8) of the insert 35 with a high coefficient of friction surface 43 (see FIG. 8) having a saw tooth geometry. The saw tooth surface 43 has its effective coefficient of friction increased when the second sheet 42' (see FIG. 2) encounters an angled portion 44 (see FIG. 8). Thus, the second sheet 42' (see FIG. 2) is held back from double feeding by the high coefficient of friction surface 43 (see FIG. 8) with the increased slope. The distance between two of the angled portions 44 of the surface 43 is 1 mm while each of the angled portions 44 occupies 0.1 mm in the same direction.

Each of the ribs 26 (see FIG. 1) and 27 is supported by the body 29 (see FIG. 2) having a hook 45 at its upper end fitting over a thin portion 46 of the vertical surface 17' of the dam. The body 29 of each of the ribs 26 and 27 has a tab 47 (see FIG. 9) at its bottom end for disposition within a hole in the bottom surface 15 (see FIG. 1) of the tray 10. An angled portion 49 (see FIG. 3) extends from the tab 47 to retain the body 29 within the hole in the bottom surface 15 (see FIG. 1) of the tray 10.

Figure 6:
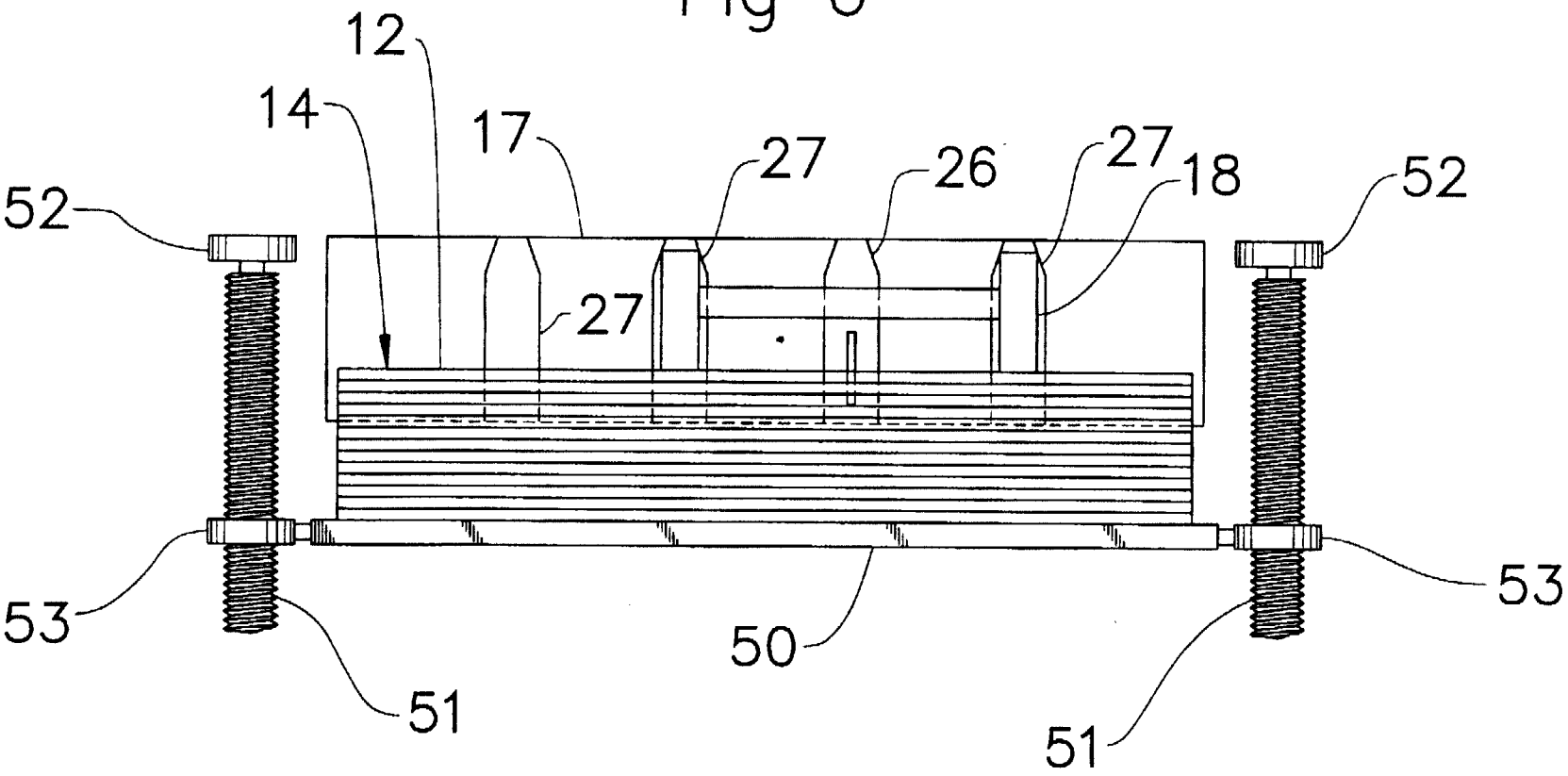
FIG. 6 is an end elevational view of a portion of a printer moving a stack of sheets of media supported by an elevator.

Instead of supporting the stack 14 of the sheets 12 in the tray 10 when the stack 14 has a relatively large number of the sheets 12, the stack 14 may be supported on an elevator 50 (see FIG. 6). The elevator 50 is moved parallel to the axes of a pair of lead screws 51 when the lead screws 51 are rotated.

Each of the lead screws 51 is supported at its upper end by a fixed bearing 52 and at its lower end by a fixed bearing (not shown), which is the same as the fixed bearing 52. A connector 53 at each side of the elevator 50 cooperates with one of the lead screws 51 to transfer its rotary motion into linear motion of the elevator 50.

The feed rollers 18 (see FIG. 1) have their surfaces closest to the inclined surface 17 spaced 2.85 mm from the end surface of the projection 36 (see FIG. 2), as measured by the distance between a line tangent to the feed rollers 18 closest to projection 36 of the insert 35 and parallel to the end surface of the projection 36. The length of the insert 35 is 28.2 mm.

The feed rollers 18 (see FIG. 1) have a diameter of 30 mm and a width of 10 mm. The axis of rotation of the feed rollers 18 is 83.25 mm from the pivot axis of the arm 19. The top of the vertical surface 17' is 47 mm from the top of the bottom surface 15 of the tray 10 as is the pivot axis of the arm 19. The inclined surface 17 is at an obtuse angle of 110° to the top of the bottom surface 15 of the tray 10.

The centers of the four ribs 27 in FIG. 1 are located from a fixed left edge, which has the left edge of the sheets 12 bearing thereagainst, at distances of 14, 42.7, 132.7, and 177.7 mm. The centers of the three ribs 26 in FIG. 1 are located from the fixed left edge at distances of 60, 87.7, and 112 mm. The distance from the fixed left edge to the right edge of the inclined surface 17 is 217 mm.

The centers of the three ribs 27 in FIG. 6 are located from a fixed left edge, which has the left edge of the sheets 12 bearing thereagainst, at distances of 42.7, 132.7, and 177.7 mm, while the center of the rib 26 is 87.7 mm from the fixed left edge. The distance from the fixed left edge to the right edge of the inclined surface 17 is 217 mm.

In operation, the feed rollers 18 (see FIG. 1) rotate to move the sheets 12 laterally by pushing the sheets 12 until the ends of the sheets 12 encounter the projection 36 (see FIG. 4) of the insert 35. The feed rollers 18 (see FIG. 1) are spaced away from the projection 36 (see FIG. 4) of the insert 35 a distance too far for any multiple feed of the sheets 12 (see FIG. 1) to cause a pinch relationship of the sheets 12 between the feed rollers 18 and the projection 36 (see FIG. 4) of the insert 35.

Figure 12:
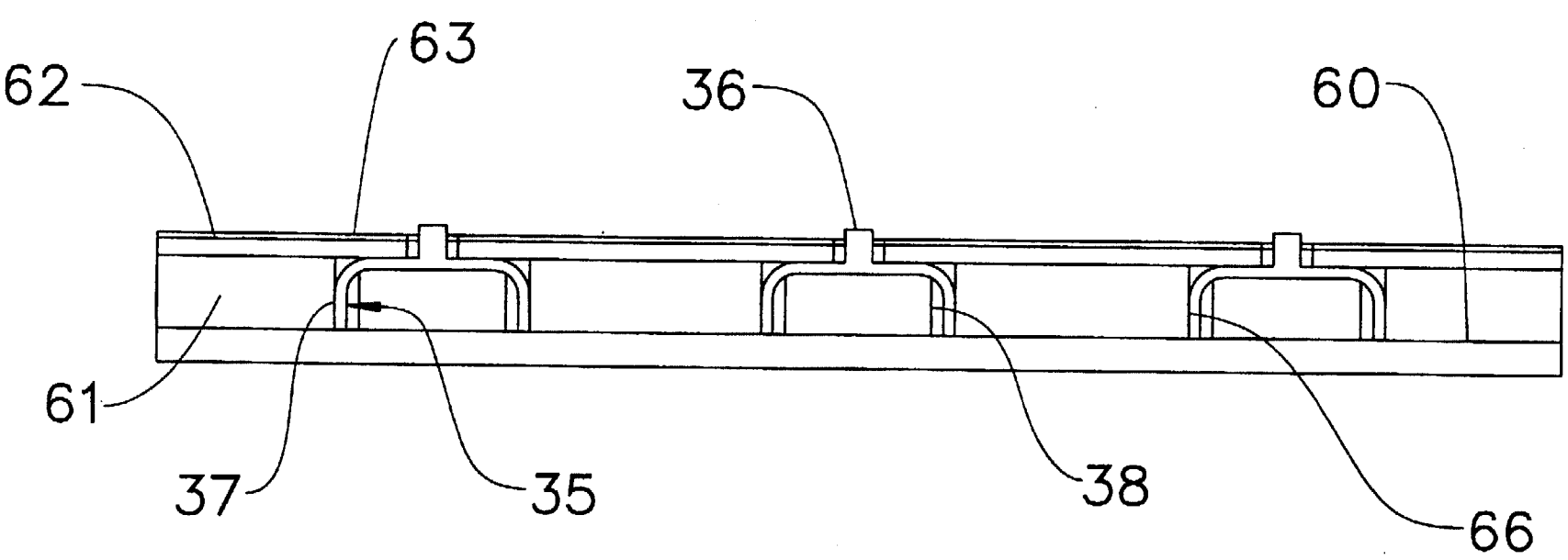
FIG. 12 is a bottom plan view of the dam of FIG. 11.

Referring to FIG. 12, there is shown a dam having an inclined surface 60 of metal. The inclined surface 60 is the same as the inclined surface 17 of FIG. 1.

A spacer 61 (see FIG. 12) of metal attaches a plate 62 of metal to the inclined surface 60. The plate 62, which has a coating 63 of a low friction material such as TEFLON fluoropolymer, for example, adhered thereto, is parallel to the inclined surface 60.

Figure 11:
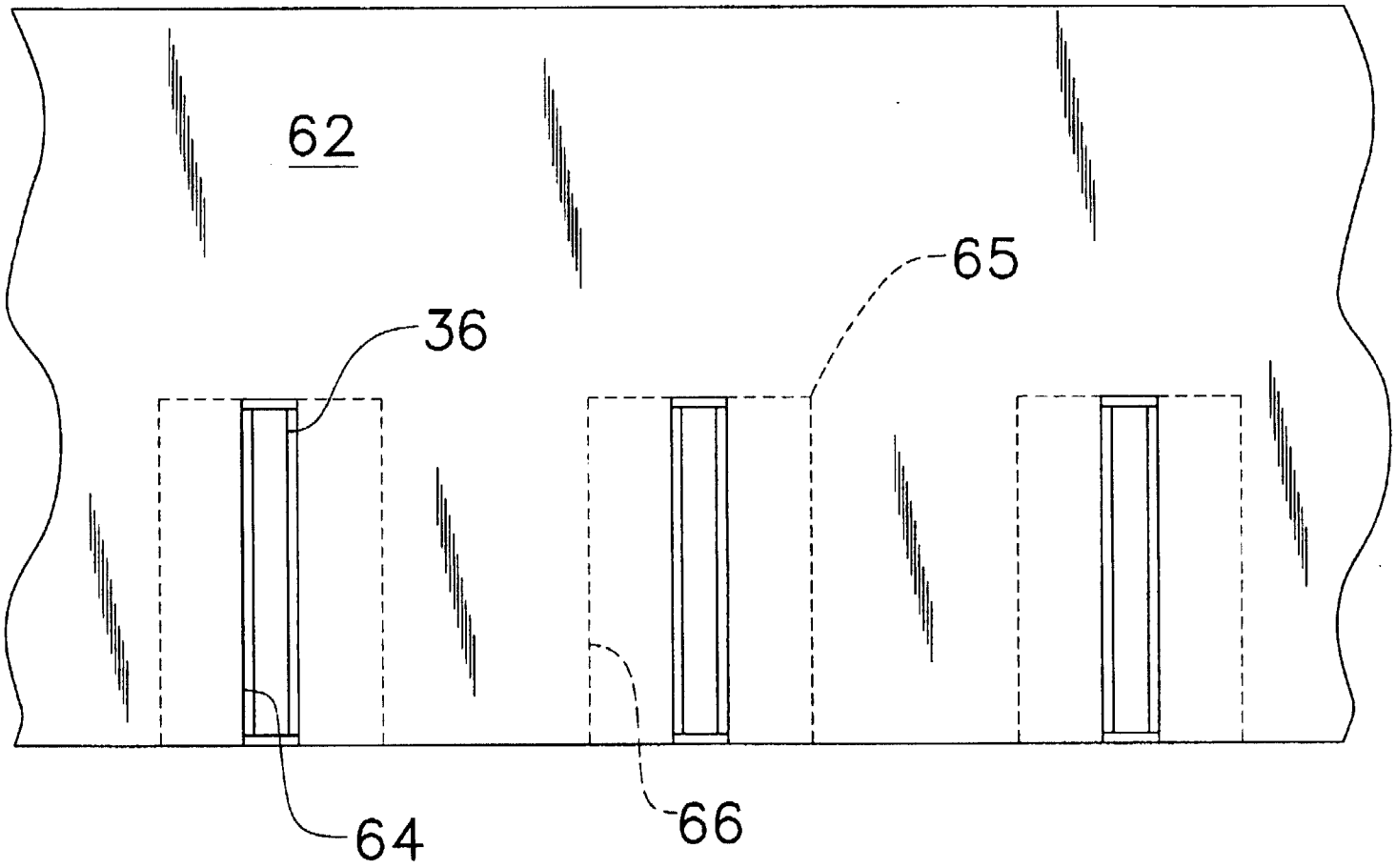
FIG. 11 is a front elevational view of a modification of the dam.

The plate 62 is formed with slots 64 (see FIG. 11) communicating with cut out portions 65 in the spacer 61. Except for slots 64, plate 62 covers the entire surface 60. This enables one of the inserts 35 (see FIG. 12) to have the projection 36 extend through one of the slots 64 (see FIG. 1). The side walls 37 (see FIG. 12) of the insert 35 are attached to surfaces 66 (see FIG. 11) of the cut out portion 65. The foam rubber body 38 (see FIG. 12) is disposed to exert a preload on the insert 35 as previously discussed.

While the sheet separator of the present invention has been shown and described as being used with a printer, it should be understood that the sheet separator of the present invention may be used with any apparatus feeding a sheet from a stack to a processing station, for example, in which only one sheet at a time is to be fed from the stack to the processing station.

An advantage of this invention is that a sheet feeding mechanism can feed sheets of media in which the sheets in one stack of sheets are of substantially the same thickness but a different thickness than the sheets in another stack. Another advantage of this invention is that it reduces the tendency for multi-sheet feeding when a stack of sheets is composed of flexible sheets and another stack has stiff sheets when a dam is the sheet separator.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An apparatus for removing the uppermost of the sheets in a stack of sheets from the stack of sheets and transporting it towards a processing station including:

support means for supporting a stack of sheets;

advancing means for engaging the uppermost sheet of the stack of sheets on said support means to advance the uppermost sheet from the stack of sheets;

an inclined element disposed in the path of movement of the uppermost sheet as it is advanced by said advancing means, said inclined element being downstream and spaced from aid advancing means, and said inclined element being inclined from its bottom to its top away from said support means at an obtuse angle to said support means;

and said inclined element including:

a first surface of a relatively high coefficient of friction at least one location thereon for engagement by each fed sheet during its advancement;

and a second surface of a relatively low coefficient of friction adjacent said first surface where said first surface is engaged by the sheet being advanced, covering said inclined element except at said first surface, and having an area of engagement with the advancing sheet larger than the area of engagement of the advancing sheet with said first surface.

2. The apparatus according to claim 1 in which said first surface is movable relative to said second surface when said first surface is engaged by a sheet being advanced relative thereto.

3. A sheet separator for separating adjacent sheets of media being fed from a stack of sheets including:

an inclined element adjacent an end of a stack of sheets and inclined at an obtuse angle to the end of the stack of sheets;

said inclined element including a base surface and a plurality of substantially parallel ribs extending from said base surface;

at least one of said substantially parallel ribs having a first surface of a relatively high coefficient of friction and a second surface of a relatively low coefficient of friction along which each sheet is advanced, each of said first and second surfaces being substantially parallel to said base surface and to each other, said second surface being proximate said first surface;

and at least two of said substantially parallel ribs having only said second surface, each of said substantially parallel ribs having each of said first and second surfaces disposed between two of said substantially parallel ribs having only said second surface.

4. The sheet separator according to claim 3 in which said first surface is movable relative to said second surface of each of said substantially parallel ribs having each of said first and second surfaces when said first surface is engaged by a sheet being advanced relative thereto.

5. The sheet separator according to claim 4 in which:

each of said substantially parallel ribs includes a body of metal;

said second surface of each of said substantially parallel ribs is a coating of a relatively low coefficient of friction on said body of metal;

and said first surface of each of said substantially parallel ribs having each of said first and second surfaces is a resilient material.

6. The sheet separator according to claim 5 in which:

said body of each of said substantially parallel ribs having each of said first and second surfaces has a longitudinal slot therein and extending through said second surface;

and an insert is disposed within said body and has a portion constituting said first surface protruding beyond said second surface through said longitudinal slot therein and movable relative to said second surface when engaged by an advancing sheet so that only said first surface continues to engage the advancing sheet.

7. The sheet separator according to claim 6 in which:

at least four of said substantially parallel ribs extend from said base surface;

and only one of said substantially parallel ribs has each of said first and second surfaces.

8. The sheet separator according to claim 6 in which:

at least four of said substantially parallel ribs extend from said base surface;

and at least two of said substantially parallel ribs has each of said first and second surfaces.

9. A sheet separator for separating adjacent sheets of media being fed from a stack of sheets including:

an inclined element adjacent an end of a stack of sheets and inclined at an obtuse angle to the end of the stack of sheets;

said inclined element having a first surface of a relatively high coefficient of friction and a second surface of a relatively low coefficient of friction along which each sheet is advanced, said first surface being proximate said second surface;

and said first surface being a biased by resilient, non-metallic material beyond said first surface for initial engagement by each advancing sheet.

10. The separator according to claim 9 in which said non-metallic material is a foam or polymeric material.

11. An apparatus for removing the uppermost of the sheets in a stack of sheets from the stack of sheets and transporting it towards a processing station including:

support means for supporting a stack of sheets;

advancing means for engaging the uppermost sheet of the stack of sheets on said support means to advance the uppermost sheet from the stack of sheets;

an inclined element disposed in the path of movement of the uppermost sheet as it is advanced by said advancing means, said inclined element being downstream and spaced from said advancing means, and said inclined element being inclined from its bottom to its top away from said support means at an obtuse angle to said support means;

and said inclined element including:

a base surface;

a plurality of substantially parallel ribs extending from said base surface;

at least one of said substantially parallel ribs having a first surface of a relatively high coefficient of friction and a second surface of a relatively low coefficient of friction along which each sheet is advanced, each of said first and second surfaces being substantially parallel to said base surface and to each other;

and at least two of said substantially parallel ribs having only said second surface, each of said substantially parallel ribs having each of said first and second surfaces disposed between of two of said substantially parallel ribs having only said second surface.

12. The apparatus according to claim 11 in which said first surface is movable relative to said second surface of each of said substantially parallel ribs having each of said first and second surfaces when said first surface is engaged by a sheet being advanced relative thereto.

13. The apparatus according to claim 12 in which:

each of said substantially parallel ribs includes a body of metal;

said second surface of each of said substantially parallel ribs is a coating of a relatively low coefficient of friction on said body of metal;

and said first surface of each of said substantially parallel ribs having each of said first and second surfaces is a resilient material.

14. The apparatus according to claim 13 in which:

said body of each of said substantially parallel ribs having each of said first and second surfaces has a longitudinal slot therein and extending through said second surface;

and an insert is disposed within said body and has a portion constituting said first surface protruding beyond said second surface through said longitudinal slot therein and movable relative to said second surface when engaged by an advancing sheet so that only said first surface continues to engage the advancing sheet.

15. The apparatus according to claim 14 in which:

at least four of said substantially parallel ribs extend from said base surface;

and only one of said substantially parallel ribs has each of said first and second surfaces.

16. The apparatus according to claim 14 in which:

at least four of said substantially parallel ribs extend from said base surface;

and at least two of said substantially parallel ribs has each of said first and second surfaces.

17. The apparatus according to claim 13 in which:

at least four of said substantially parallel ribs extend from said base surface;

and only one of said substantially parallel ribs has each of said first and second surfaces.

18. The apparatus according to claim 13 in which:

at least four of said substantially parallel ribs extend from said base surface;

and at least two of said substantially parallel ribs has each of said first and second surfaces.

* * * * *